US007290687B2

(12) United States Patent
Wu

(10) Patent No.: US 7,290,687 B2
(45) Date of Patent: Nov. 6, 2007

(54) GARMENT HANGER AND CLAMPS

(76) Inventor: Raymond Wu, 12640 Belinda Ct., Lynwood, CA (US) 90262

( * ) Notice: Subject to any disclaimer, the term of this patent is extended or adjusted under 35 U.S.C. 154(b) by 187 days.

(21) Appl. No.: 11/082,814

(22) Filed: Mar. 18, 2005

(65) Prior Publication Data

US 2006/0208011 A1 Sep. 21, 2006

(51) Int. Cl.
*A41D 27/22* (2006.01)

(52) U.S. Cl. ..... 223/96; 223/91; 223/93; 24/521; 24/564

(58) Field of Classification Search ..... 223/90, 223/91, 93, 96, DIG. 2, 85; 24/30.5 R, 521, 24/556, 564, 501
See application file for complete search history.

(56) References Cited

U.S. PATENT DOCUMENTS 2,332,772 A * 10/1943 Amer ..... 24/346
3,755,859 A * 9/1973 Solari ..... 223/87
4,716,634 A * 1/1988 Fan ..... 24/545
4,722,120 A * 2/1988 Lu ..... 24/489
4,884,727 A * 12/1989 Blanchard ..... 223/93
5,052,085 A * 10/1991 Gau ..... 24/501
6,199,728 B1 * 3/2001 Cohen ..... 223/96
6,842,951 B1 * 1/2005 Barre et al. ..... 24/499

* cited by examiner

*Primary Examiner*—Gary L. Welch
*Assistant Examiner*—Nathan E Durham
(74) *Attorney, Agent, or Firm*—Troxell Law Office, PLLC

(57) ABSTRACT

A garment hanger having two clamps respectively provided on two ends thereof, each clamp includes a first jaw and a second jaw adapted to closing to each other for clamping; wherein the first jaw has on its inner surface thereof an elliptical protrusion, and the second jaw has on its inner surface thereof ridges circling to form an elliptical shape; the ridges in the elliptical shape form a recessed area for accommodating the elliptical protrusion, the protrusion and the recess are made mainly of soft materials such as rubber, so that taking advantage of the friction of the rubber, softer garments can be firmly clamped without damaging material of the garments.

9 Claims, 5 Drawing Sheets

GARMENT HANGER AND CLAMPS

BACKGROUND OF THE INVENTION

1. Field of the Invention

The present invention relates to a garment hanger and clamps used thereon, and more particularly to clamps each with a pair of clamping arms closable to each other and respectively having a protrusion and a recess thereon the clamping arms; the protrusion and the recess are made mainly of rubber in order to firmly clamp garments without damaging the material of the garments.

2. Description of the Prior Art

There are various types of garment hangers for hanging garments in the markets; in general, in order to achieve the objects of hanging more garments on a single garment hanger or put multiple decorative attached parts of a garment on a single garment hanger along with the garment, two clamps are often provided respectively on the two ends of a garment hanger.

Clamps found nowadays are variant; however, they normally are limited to being strong elastic clamps which make the two clamping arms engage in a mode of engagement of teeth set thereon the opposite claiming arms in an included angle.

In the past, as shown in FIG. 1, a clamp A10 using strong elastic clamps A11 to clamp two clamping arms A12, A13 together which in general is provided thereon the two clamping arms A12, A13 with canine teeth A14 or other sharp ridges to firmly and strongly clamp and hold garments such as jeans or those garments made from harder cloths. The garments A15 being clamped, as shown in FIG. 1A, is strongly clamped by the canine teeth A14, so that the garments can be damaged, or after a long time clamping, the garments are having on its surface clamping marks; therefore, such clamps do not suit softer garments (such as garments made of natural silk, rayon etc.).

Therefore, it is the primary objective of the present invention to provide a garment hanger with a clamp applicable to clamp softer garments firmly without damaging the clothes.

SUMMARY OF THE INVENTION

The primary objective of the present invention is to provide a garment hanger for hanging garments, clamps are provided on the garment hanger, each clamp has a pair of clamping arms closable to each other and respectively having thereon a protrusion and a recess; the protrusion and the recess are made of soft material such as rubber in order to clamp and hold softer garments without damaging the material of the garments.

To achieve the above stated objective, the garment hanger of the present invention comprises a hook for hanging garments in a suspended way; two clamps are provided on the two ends of the garment hanger for clamping clothes, each clamp includes a first jaw and a second jaw, wherein the first jaw has on its inner surface an elliptical protrusion, and the second jaw has on its inner surface ridges circling to form an elliptical shape; the ridges in an elliptical shape form a recessed area for accommodating the elliptical protrusion, thereby light and softer garments can be clamped and held without damaging the material of the garments.

The present invention will be apparent in its particular content and effects to be obtained after reading the detailed description of the preferred embodiment thereof in reference to the accompanying drawings.

DETAILED DESCRIPTION OF THE PREFERRED EMBODIMENT

Figure 1A:
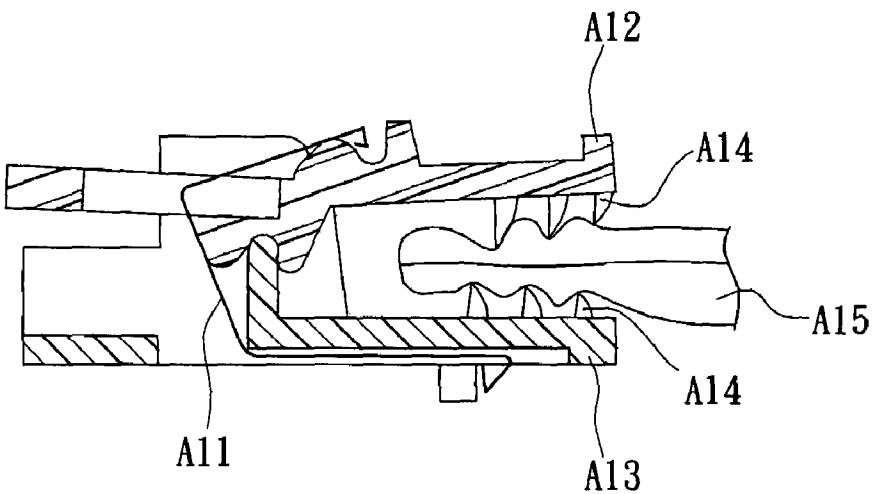
FIG. 1A PRIOR ART
FIG. 1A is a sectional schematic view showing a clamp which is having clamped garments of FIG. 1.
Figure 1:
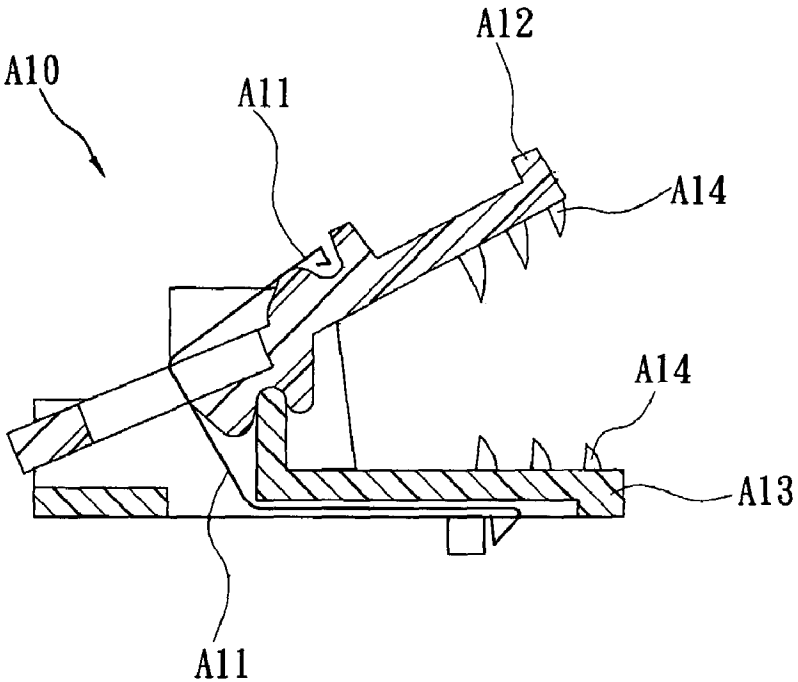
FIG. 1 PRIOR ART
FIG. 1 is a side sectional view of a clamp on a conventional garment hanger.
Figure 2:
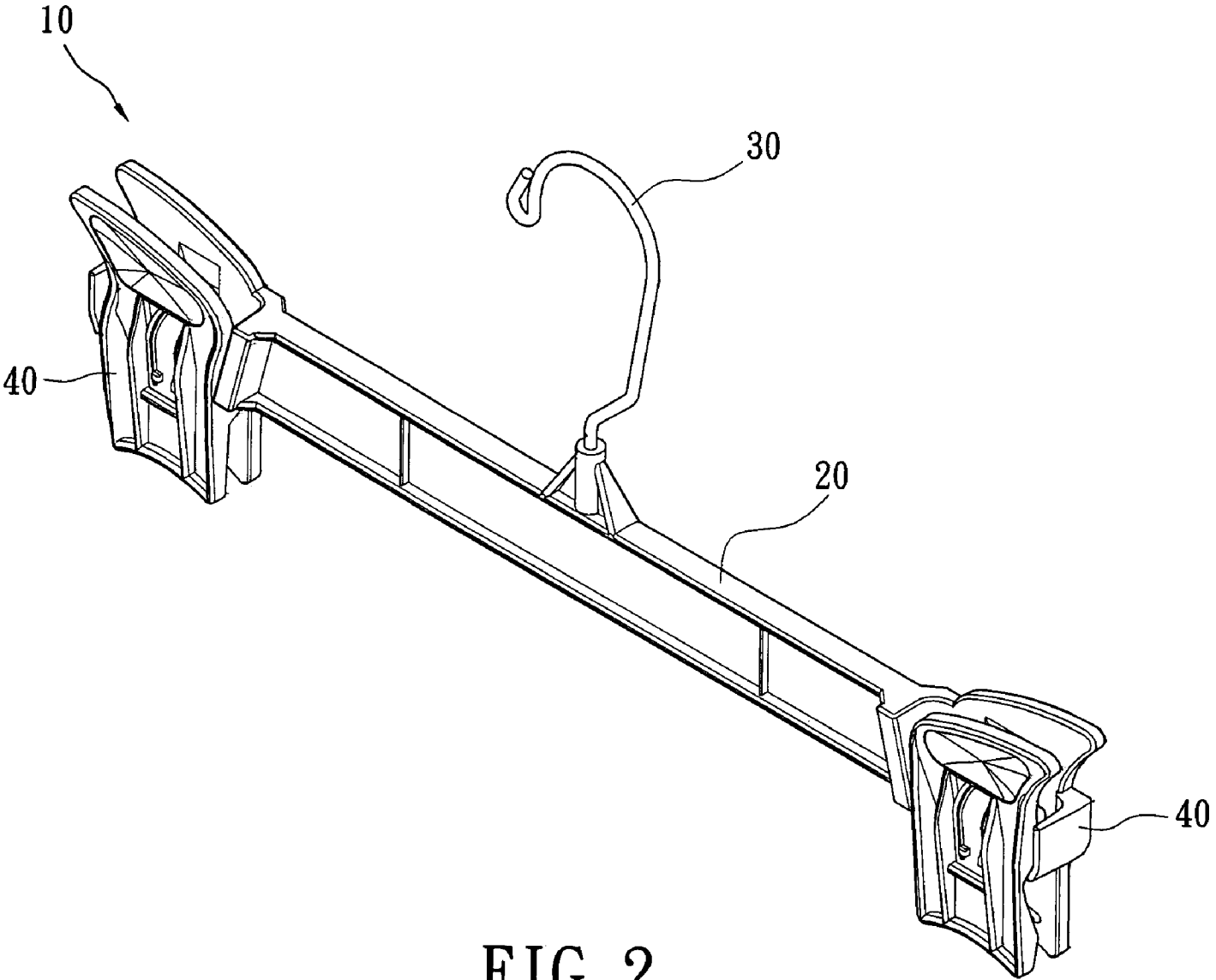
FIG. 2 is a perspective view showing the appearance of a preferred embodiment of the present invention.

Referring to FIG. 2 showing the appearance of a preferred embodiment of a garment hanger 10 of the present invention, the garment hanger 10 mainly comprises a main body 20 on which there is a hook 30, and two clamps 40 provided respectively on the two ends of the main body 20.

The main body 20 is in a shape such as an "I", a triangle or any other shape suitable for supporting garments on the main body 20, and is made of plastic by injection forming, or can be made of some other solid and durable material.

The main body 20 has thereon the hook 30 detachably connected thereto by the way of engaging or screwing etc., the material of the hook 30 preferably mainly is metal or some other durable material.

Figure 3:
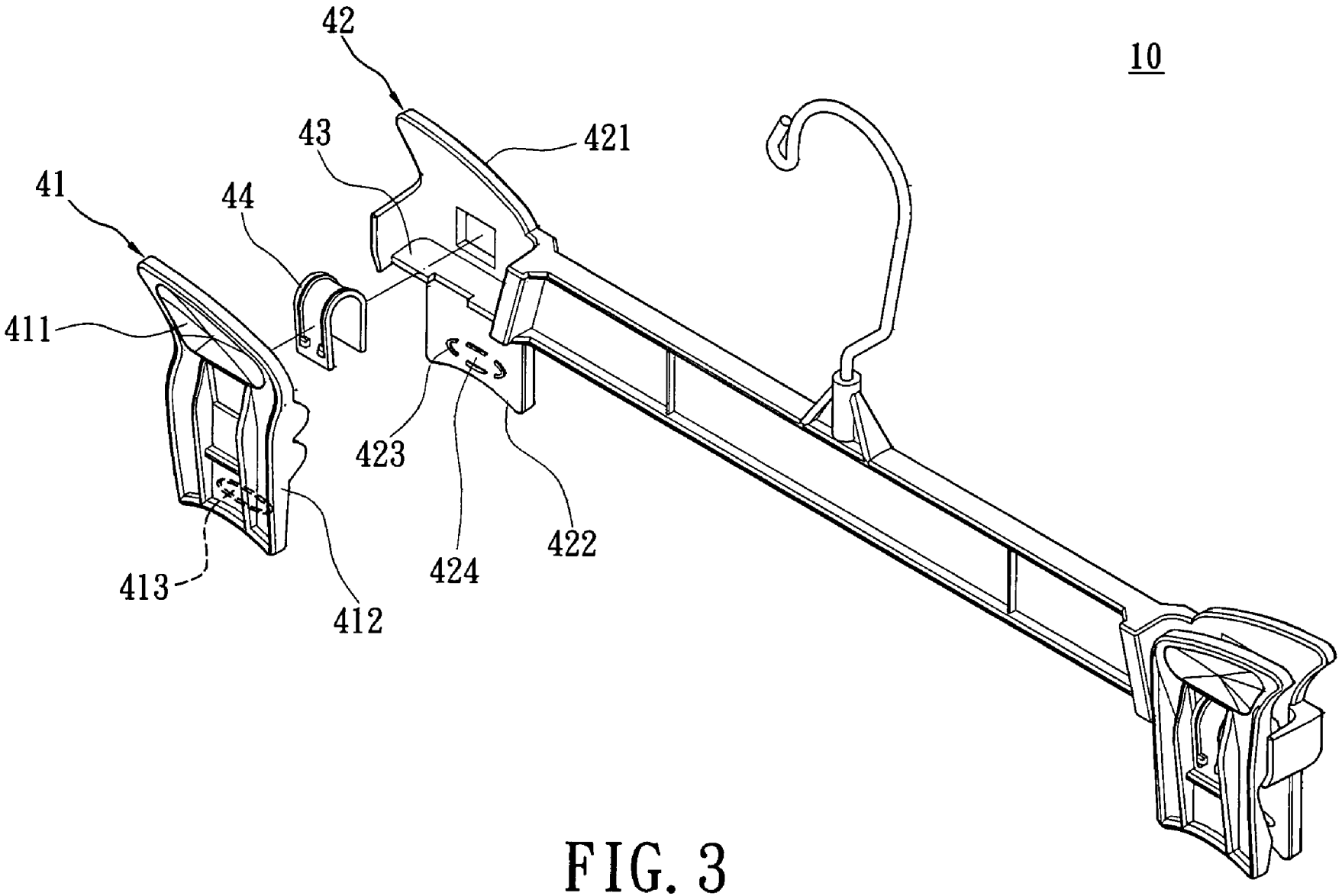
FIG. 3 is an exploded perspective view showing the garment hanger of FIG. 2.
Figure 3A:
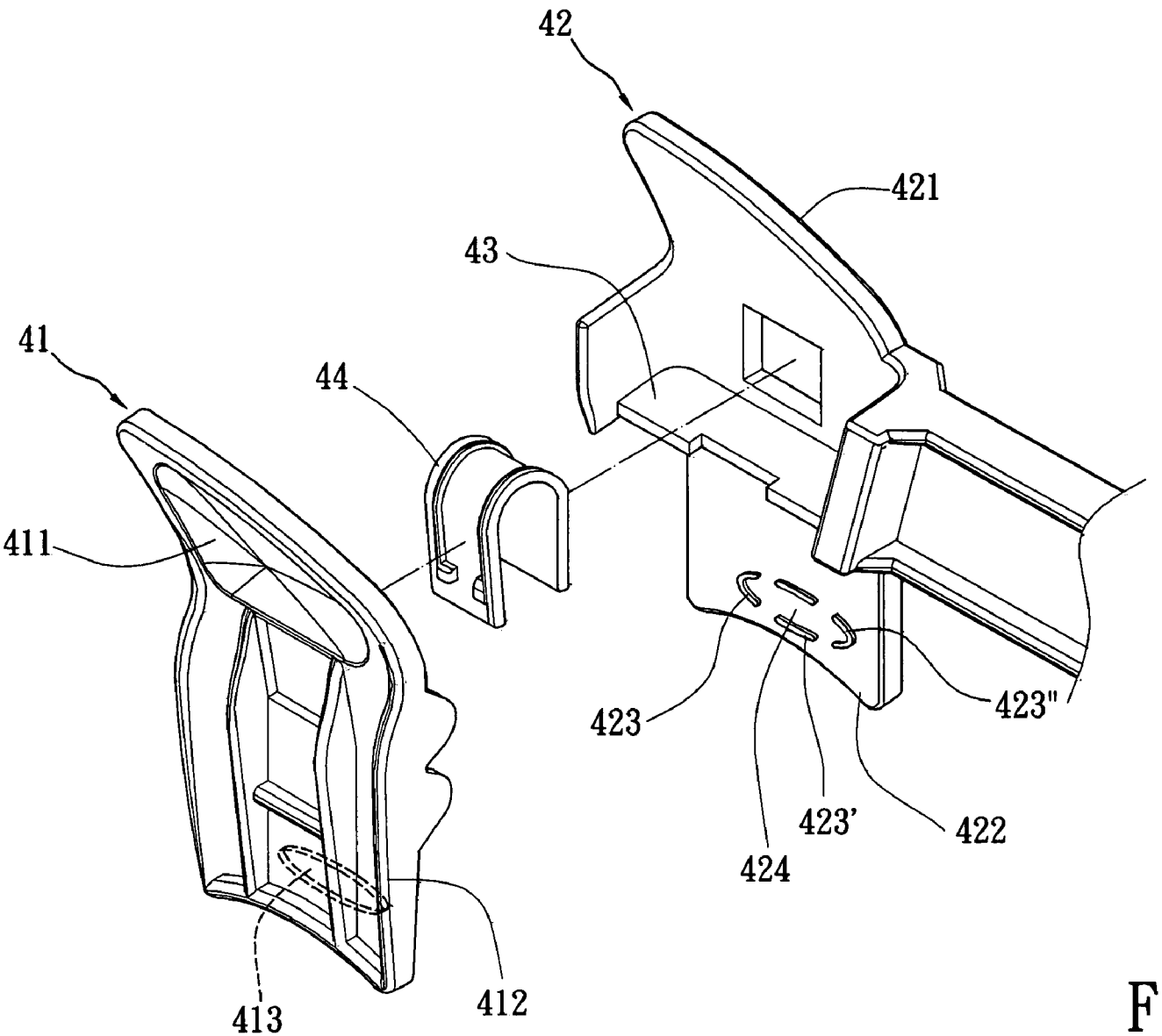
FIG. 3A is an enlarged sectional view taken from FIG. 2.

As shown in FIG. 3, the main body 20 is provided on its two ends with two clamps 40 respectively, each clamp 40 includes a first clamping arm 41 and a second clamping arm 42; the first clamping arm 41 has a first holding portion 411 and a first jaw 412 respectively located on the upper and the lower ends of the first clamping arm 41, and the second clamping arm 42 has a second holding portion 421 and a second jaw 422 respectively located on the upper and the lower ends of the second clamping arm 42; and the first clamping arm 41 is pivotally connected with the second clamping arm 42 (or a lever 43 can be provided on the first clamping arm 41 or on the second clamping arm 42, and a U shaped elastic clamp 44 can be used to clamp tight the first clamping arm 41 and the second clamping arm 42), thereby when the first holding portion 411 and the second holding portion 421 respectively of the first clamping arm 41 and the second clamping arm 42 are pressed or released, the first jaw 412 and the second jaw 422 can be opened and closed with an angular motion about the pivotal connecting point (or about the lever 43) as a fulcrum.

Wherein the first jaw 412 has on its inner surface an elliptical protrusion 413, and the second jaw 422 has on its inner surface ridges 423 circling to form an elliptical shape; the ridges 423 in an elliptical shape form a recessed area 424 for accommodating the elliptical protrusion 413 (as shown in FIG. 3A), in which the ridges 423 in an elliptical shape are non-continuous or intermittent ridges 423, 423', 423", materials of the protrusion 413 and the ridges 423 are soft materials such as rubber, in order that light and softer garments such as made of natural silk, rayon etc. can be clamped and held without being damaged. And more, the elliptical protrusion 413 and the ridges 423 can also be made of rubber to increase their friction effect against the clothes, in order that the garments can be firmly clamped by them.

Figure 4:
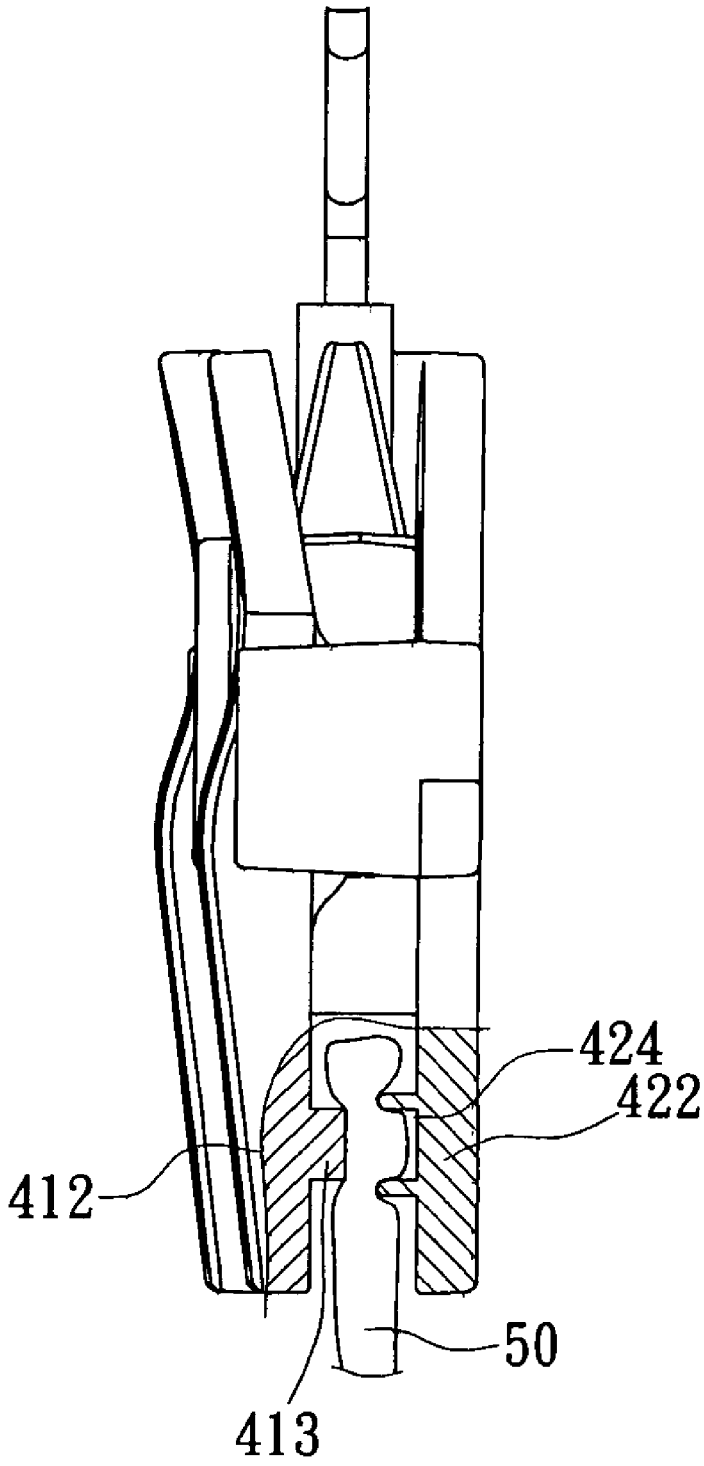
FIG. 4 is a sectional schematic side view showing a clamp of a garment hanger in clamping clothing.

As shown in FIG. 4, in practicing the present invention, the first jaw 412 and the second jaw 422 are used as the parts for clamping the garments 50, wherein the protrusion 413 of the first jaw 412 is exactly engaged in the recessed area 424 of the second jaw 422 to tightly clamp the garments 50. And the protrusion 413 and the recessed area 424 can be made of soft materials such as rubber, so that when the clamps of the present invention are used to clamp the garments of softer materials, the material of the garments is not subject to being damaged.

In conclusion, according to the description disclosed above, the present invention surely can achieve the expected objective thereof to provide a garment hanger that can firmly clamp garments without damaging the material of the garments.

The embodiment stated above is only for illustrating the present invention, it will be apparent to those skilled in this art that various equivalent modifications or changes according to the idea of and without departing from the spirit of this invention shall also fall within the scope of the appended claims.

The invention claimed is:

1. A garment hanger comprising:

a main body;

a hook connected with an upper side of said garment hanger for hanging garments in a suspended way; and two clamps provided respectively on two ends of said main body, each of said clamps includes a first jaw and a second jaw adapted to closing to each other for clamping;

said first jaw has on its inner surface thereof an elliptical protrusion, and said second jaw has on its inner surface thereof ridges circling to form an elliptical shape; said ridges in the elliptical shape form a recessed area for accommodating said elliptical protrusion, in order that light and softer garments is clamped and held without damaging material of said garments, wherein each of said clamps includes a first clamping arm and a second clamping arm; said first jaw and said second jaw are located on lower ends respectively of said first and said second clamping arms, said first clamping arm is pivotally connected with said second clamping arm: said first clamping arm has a first holding portion, and said second clamping arm has a second holding portion; an elastic clamp is used to clamp tightly said first clamping arm and said second clamping arm, when said first clamping arm and said second clamping arm are pressed or released, said first jaw and said second jaw are closed or opened with an angular motion about a pivotal connecting point as a fulcrum, wherein said ridges in the elliptical shape are non-continuous ridges spaced apart predetermined distances and forming an elliptical shape.

2. The garment hanger as claimed in claim 1, wherein said elastic clamp is in a U shape.

3. The garment hanger as claimed in claim 1, wherein said garment hanger is made of plastic by injection forming.

4. The garment hanger as claimed in claim 1, wherein material of said hook is metal.

5. The garment hanger as claimed in claim 1, wherein said ridges are made of soft material.

6. The garment hanger as claimed in claim 5, wherein said soft material is rubber.

7. The garment hanger as claimed in claim 1, wherein said second clamping arm of each of the two clamps is fixed on one of the two ends of the main body.

8. A clamp for connecting with a garment hanger to clamp garments, wherein said clamp includes a first jaw and a second jaw adapted to closing to each other for clamping; said first jaw has on its inner surface thereof an elliptical protrusion, and said second jaw has on its inner surface thereof ridges circling to form an elliptical shape; said ridges in the elliptical shape form a recessed area for accommodating said elliptical protrusion, in order that light and softer garments is clamped and held without damaging material of said garments, wherein said clamp includes a first clamping arm and a second clamping arm; said first jaw and said second jaw are located on lower ends respectively of said first and said second clamping arms, said first clamping arm is pivotally connected with said second clamping arm: said first clamping arm has a first holding portion, and said second clamping arm has a second holding portion: an elastic clamp is used to clamp tightly said first clamping arm and said second clamping arm, when said first clamping arm and said second clamping arm are pressed or released, said first jaw and said second jaw are closed or opened with an angular motion about a pivotal connecting point as a fulcrum, wherein said ridges in the elliptical shape are non-continuous ridges spaced apart predetermined distances and forming an elliptical shape.

9. The garment hanger as claimed in claim 8, wherein said second clamping arm of each of the two clamps is fixed on one of the two ends of the main body.

* * * * *